United States Patent [19]

Graham

[11] Patent Number: 5,031,551

[45] Date of Patent: Jul. 16, 1991

[54] SEWING MACHINE ATTACHMENTS

[76] Inventor: Donell I. Graham, 2415 Glory "C" Rd., Medford, Oreg. 97501

[21] Appl. No.: 562,562

[22] Filed: Aug. 3, 1990

[51] Int. Cl.[5] ..... D05B 23/00; D05B 35/00

[52] U.S. Cl. ..... 112/63; 112/143; 112/147; 112/262.2

[58] Field of Search ..... 112/63, 141, 143, 147, 112/152, 262.2

[56] References Cited

U.S. PATENT DOCUMENTS

| | | | |
|---|---|---|---|
| 798,277 | 8/1905 | Goforth | 112/143 |
| 855,304 | 5/1907 | Greist | 112/143 |
| 988,528 | 4/1911 | Woehrle | 112/63 |
| 1,334,589 | 3/1920 | Beckert | 112/143 |
| 2,107,837 | 2/1938 | Robbins | 112/63 |
| 2,534,534 | 12/1950 | Senter | 112/63 |
| 2,570,012 | 10/1951 | Temple | 112/63 |
| 3,142,277 | 7/1964 | Jordan | 112/143 |
| 3,752,100 | 8/1973 | Sharp | 112/143 |
| 4,506,613 | 3/1985 | Ragnebring | 112/143 |

*Primary Examiner*—Werner H. Schroeder
*Assistant Examiner*—Paul C. Lewis
*Attorney, Agent, or Firm*—Andrew E. Barlay

[57] ABSTRACT

Apparatus and method for sewing a length of fabric into seamed tubing that has a consistently uniform diameter and cross-sectional configuration along substantially its entire length, wherein simplified guide means and steps are employed for controlling the full movement of the length of the fabric forming the tubing to and through a sewing zone.

14 Claims, 3 Drawing Sheets

SEWING MACHINE ATTACHMENTS

BACKGROUND OF THE INVENTION

This invention relates to sewing machine attachments and more particularly to attachments for use in sewing fabric tubes that have a consistently uniform diameter and cross-sectional configuration throughout their entire length.

One of the major problems in the fabric sewing art is to sew a straight and even seam on any length of fabric tube particularly where the tube is of a small diameter and is used to produce spaghetti-type straps. This problem is particularly acute in the case of bias cut fabric strips utilized for many fabric tubular members because of their stretchability and flexibility in sewing articles of complex configurations. When the fabric strips are cut on the bias, i.e. at a 45° angle to the grain of the fabric, the fabric tends to act like the well-known Chinese finger trap made of woven grasses or the like whereby the harder one pulls, the tighter it gets. Further, some loosely woven fabrics that can be made into desirable tubing are particularly difficult to control during sewing when cut on the bias. One important factor in home as well as in industrial sewing is the ability to create clothes and accessories which have a professional appearance. A further and equally important requirement is for the operator to be able to use a relatively simply constructed and easy to manipulate sewing machine attachment. In other words, the attachment must be a practical piece of equipment that can be readily affixed to a standard sewing machine and then operated without the user having to resort to looking up and following a complex set of operating instructions. Such an attachment is provided by the instant invention.

Various prior art devices have not proven entirely satisfactory in providing the simplified sewing machine attachment required by sewing machines used both commercially and at home for sewing simple, consistently uniform and attractive tubular fabric products. The reason for such inadequacy resided primarily in their complex design and the high level of skill required for their successful use. Further, most prior art devices were singular use devices, i.e. they were limited to producing but a single sized finished tubular product.

Prior art sewing machine attachments, such as those illustrated in U.S. Pat. Nos. 983,528, 2,570,012, 2,534,534 and 2,818,826 are representative of such complexity and the difficulties involved in utilizing such equipment. For example, they include special arbor-like elements for producing on the same equipment single size fabric tubing seamed on the outside and then inverted to conceal the seam. Thereafter, a filler material is inserted in the inverted tubing. Other sewing machine attachments for producing tubular or folded and seamed fabric items, such as are shown in U.S. Pat. No. 973,530, require extreme care in threading the cloth into and through the attachments because of the close tolerances required in precisely overlapping the edges of the fabric to be seamed. Moreover, the attachment shown in this patent is no readily adaptable for sewing differently sized tubular fabrics and in one embodiment it employs a horizontally swinging curved sewing needle that would appear to be difficult to control in sewing a straight seam. U.S. Pat. No. 2,314,202 discloses a further complex sewing machine attachment for producing biased or helically seamed tubing wherein the seam is inverted for appearance sake.

The intricate sewing machine attachment of U.S. Pat. No. 1,836,742 is intended for use in producing blind stitch piping wherein the fabric edges are folded several times and then stitched to form piping with the stitches being visible on one side only.

The several fabric guides of U.S. Pat. No. 1,157,384 are of a convoluted cross-section and not readily adaptable for producing simple fabric tubing.

Finally, the lack of a simple and readily useable sewing machine attachment for producing consistently uniformly dimensioned tubular fabric is further illustrated at pages 60 and 61 of a sewing machine manual published by the Singer Sewing Machine Company, entitled "Singer Electric Sewing Machine -206K43", copyright 1952–53. The pages referred to in this manual disclose a sewing machine attachment for sewing binding materials onto a piece of cloth wherein a multi-slotted binding scroll is employed to cause different types of binding to encircle the cloth edge to be reinforced.

SUMMARY OF THE INVENTION

The present invention concerns an apparatus and a method for consistently forming fabric tubes of substantially uniform cross-sections and diameters throughout their length from various sizes and types of fabric without the need for multiple and complex sewing machine fixtures. After being formed, the tubes, depending upon the use to which they are to be put, can then be readily and easily inverted to conceal the previously formed seam even when the fabric material has been cut on the bias or against the grain. After being formed such tubes can then be filled with cording or other suitable material while being inverted. An example of the type of instrumentality that may be used for inversion purposes is shown in my prior U.S. Pat. No. 4,620,649. A fabric tube of uniform cross-section and diameter throughout, as produced by the present invention, is most desirable in order to be able to fill the same with uniformly sized reinforcing expansion material and also for the sake of appearance. The present invention is further useful in the creation of bias cut tubing of uniform diameter, which is required in many instances because of its pliability and versatility in cornering and piping.

In contrast to prior sewing practice where the aligned cut edges of a length of fabric have been used to guide the fabric past the seaming needle to form the tube, the instant invention utilizes in an improved fashion the fold of the fabric along with a unique sewing machine attachment guide element to control sewing of the seam uniformly and evenly from one end of the fabric to the other. In the past, any unevenness in the cut fabric edges, when used as a seam sewing guide, has shown up in irregular uneven seams which not only detracted from the appearance of the final product but also presented problems at the time when an attempt was made to stuff the tubing with the usual filler cord.

In summary, it is the primary purpose of this invention to provide an improved, readily adjustable sewing machine attachment and a sewing method that are easy to use by professional and nonprofessional sewers, such as seamstresses, tailors, upholsterers and homemakers and the like for consistently producing fabric tubing of substantially uniform diameter from one end of a given length of fabric to the other in different sizes and from various materials including loosely woven materials and fabrics cut on the bias.

Other features and advantages of the instant invention will become more apparent from the following detailed description when taken in conjunction with the accompanying drawings.

DETAILED DESCRIPTION OF THE INVENTION

Figures 1, 1A:
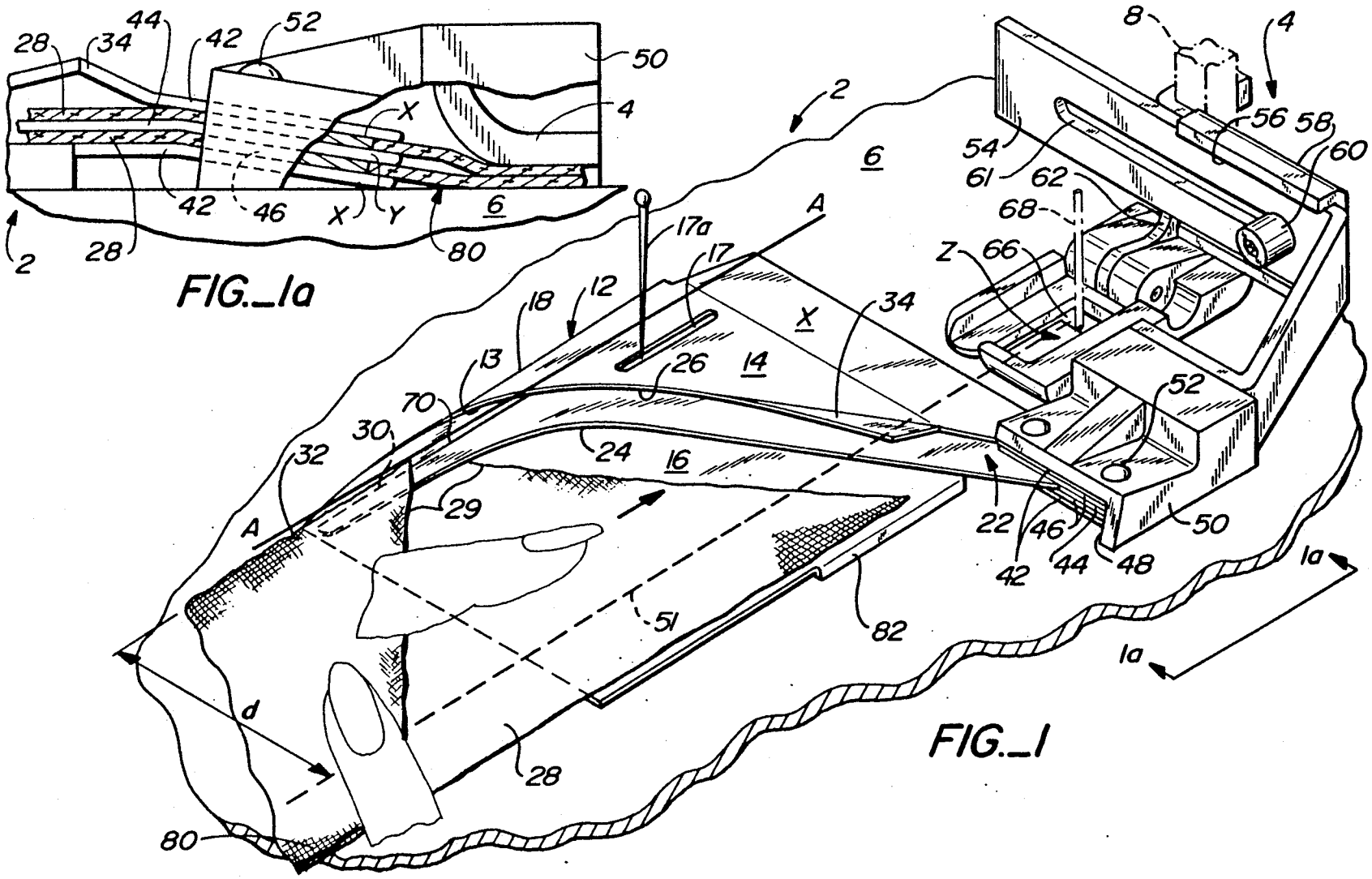
FIG. 1 is an isometric view of one embodiment of the sewing machine attachment of the instant invention with parts broken away, other parts omitted and still other parts being shown in dotted lines.
FIG. 1*a* is a side elevational view with parts broken away of the attachment of FIG. 1 when taken generally along line 1*a*—1*a* thereof, this Figure illustrating how the slope of the various attachment guide elements in the area closest to the presser foot and sewing zone advantageously direct the top and bottom layers of the fabric uniformly and evenly under the presser foot and into the sewing zone.

With further reference to the drawings, wherein preferred embodiments of the invention are depicted and particularly FIGS. 1 and 1*a*, it will be observed that the sewing machine attachment 2 of the invention can be used with various types of sewing machines by being connected to a standard presser foot 4 mounted over the usual sewing machine bed plate 6 by way of a sewing machine presser shaft or bar 8. Attachment 2, the various parts of which can be readily made of metal, plastic or combinations thereof, is generally comprised of a folded fabric guide housing 12 provided with a fabric receiving or enclosing U-shaped channel section or portion 13 formed by upper and lower legs 14 and 16 and a curved wall or web 18. Located within the channel section 13 and intermediate to the legs 14 and 16 is a fabric wrap around guide that can take the form of plate 22 having an arcuate cutaway portion 24 which along with a similar cutaway portion 26 in the top leg 14 of housing 12 facilitates the insertion or threading of a length of fabric 28 to be formed into tube through attachment 2.

In a preferred embodiment of the invention guide 22 is provided with a forwardly projecting finger segment 30 for initially engaging and guiding the fabric piece 28 cut on a bias 29 through housing 12. This finger segment 30 facilitates the entry of fabric 28 into attachment 2 by readily engaging the fold or crease 32 put in the middle of fabric 28 by the operator as the operator progressively feeds the folded cloth or fabric to and through the attachment toward the presser foot 4 and machine feed dog (not shown). Although not required, the top leg 14 of the housing 12 can be fitted with slot 17 through which the operator can insert a pin 17*a* to contact and push the leading parts of the fabric forward during the initial threading of the fabric through the attachment 2. Upper leg 14 of housing 12 is advantageously further provided with an upraised guide lip 34 for use in guiding the leading errant edge of the to fold of the bias cut fabric 28 snugly between the inner plate 22 and upper leg 14 of the housing 12.

As further indicated in the drawings, reference being made particularly to FIGS. 1 and 1*a*, the extensions 42 of housing legs 14 and 16 and extension 44 of guide 22 are secured together in sandwich fashion along with various small spacer plates 46 in the angular recess 48 of the transition member 50 by means of suitable screws or rivets 52.

The various embodiments of the invention further contemplate that attachment 2 will be adjustably affixed to the presser foot 4 in such a fashion that it can be readily and conveniently moved as a unit crossways to the sewing seam path projected by dotted line 51 on the fabric in FIG. 1 in order to permit the attachment 2 to be used to sew various sizes of tubes including the small and difficult to sew spaghetti sized fabric tubes. It also allows the use of various types of closely or loosely woven fabrics. This is accomplished by means of a slotted slide bar 54 welded or otherwise secured to or integrally formed with transition member 50, the bar being movably mounted within channel 56 of the presser foot bracket 58 by means of a locking screw 60 adjustably inserted in the slot 61 of slide bar 54 or a similar securing device well known in the art. If desired and for ease of manufacture transition member 50, slide bar 54 and bracket 58 can be injection molded in a manner known in the art. With further reference to FIG. 1, it will be observed that presser foot 4 attached to the sewing machine presser bar or shaft 8 includes a leg bracket 62 for use in affixing the same to presser shaft 8. The bottom extremity of leg bracket 62 is pivotally attached in the usual fashion to the cloth contacting part of presser foot 4. Presser foot 4 further includes the standard needle opening 66 for sewing machine needle 68 located in sewing zone Z above the usual feed dog (not shown).

Figure 2:
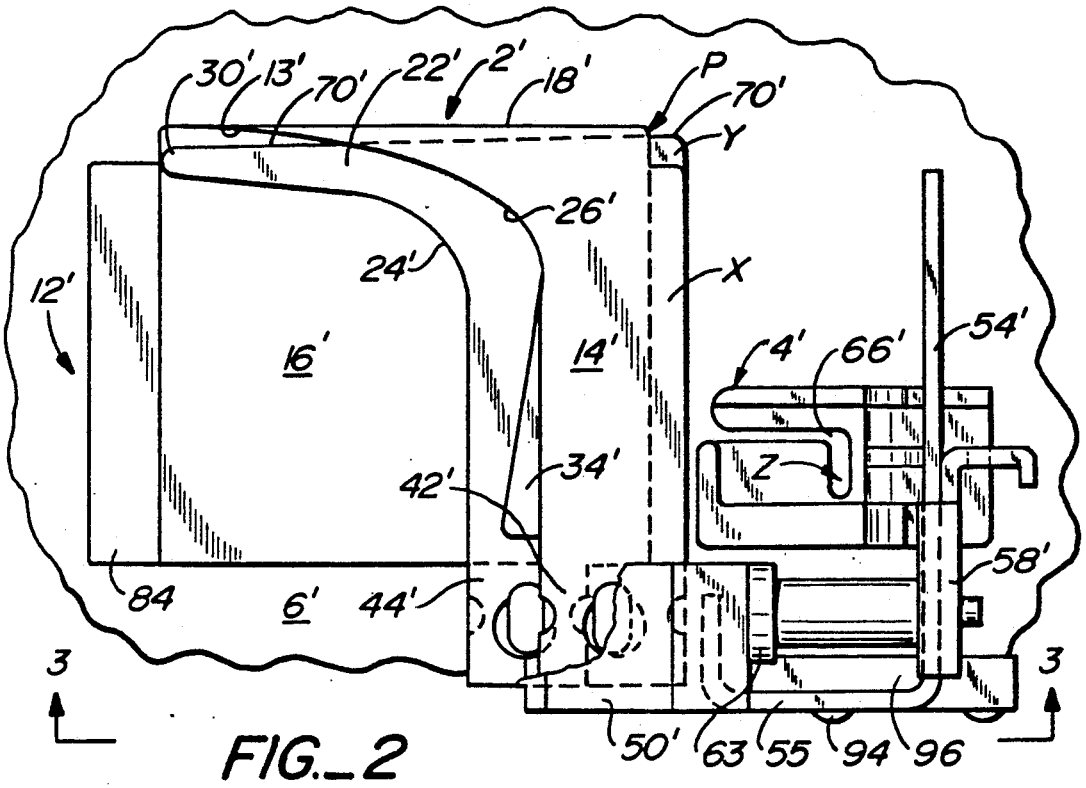
FIG. 2 is a top plan view of another embodiment of the invention.
Figure 3:
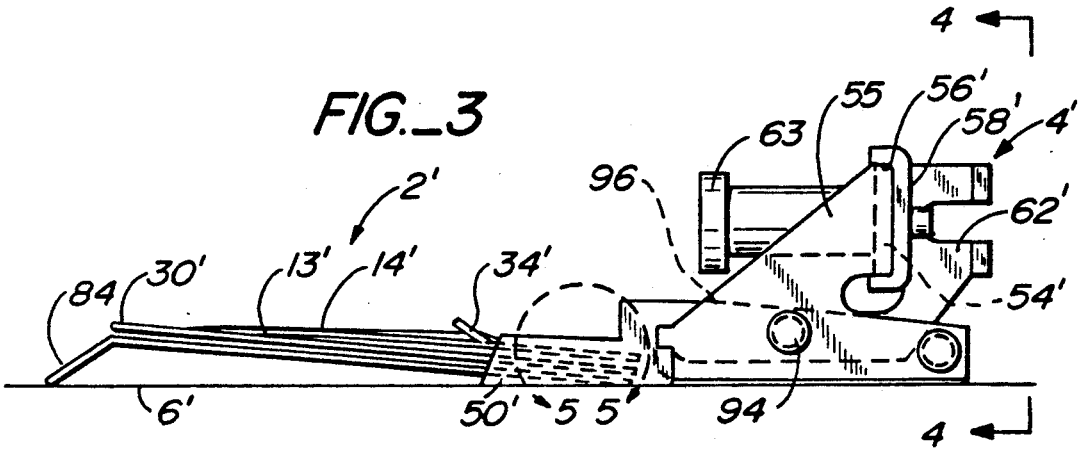
FIG. 3 is a side elevational view of the embodiment shown in FIG. 2 when taken along line 3—3 thereof.
Figure 6:
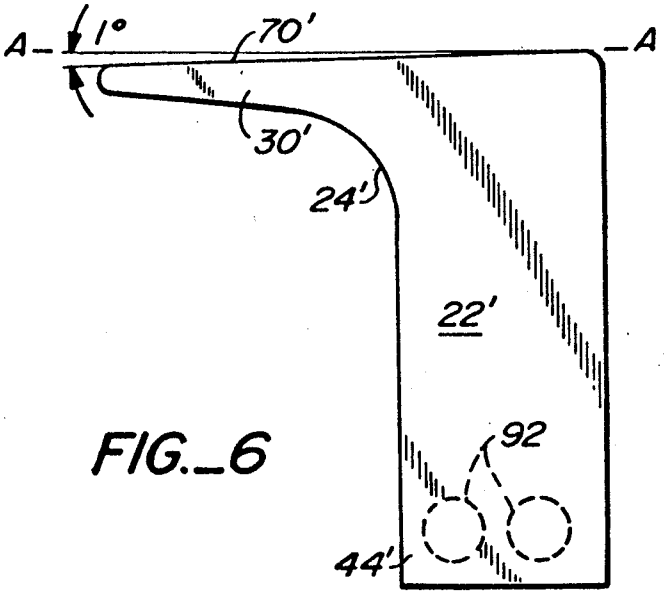
FIG. 6 is a top plan view of one form of interior wrap around guide that can be used with the sewing machine attachment of FIG. 2.

One particularly significant and advantageous feature of the sewing machine attachment 2 of this invention concerns the disposition of the fabric engaging edge 70 of the fabric wrap around guide 22 relative to the arcuate web 18 of channel section 13 for guide housing 12. As indicated in FIGS. 2 and 6 the linearly extending edge portion 70, rounded so as not to catch on the cloth, is slightly tapered or inclined at a small angle on the order of about 1° to an axis A—A. This axis A—A generally parallels the midpoint of the curved wall portion or web 18 of housing 12 as well as the seam that is to be stitched along projected path 51 that in turn not only parallels axis A—A but is also linearly aligned with sewing needle 68. Accordingly, when guide 22 is fitted intermediate to the legs 14 and 16 and within channel section 13 of housing 12, the fabric engaging edge 70 will gradually converge with but fail to fully contact the web 18 of housing 12. The closest point P (see FIG. 2) of convergence of web 18 and folding edge portion 70 occurs just before the successive portions of the folded fabric leave the attachment 2 and pass below the presser foot 4 and into sewing zone Z. This permits web 18 of housing 12 and fabric engaging edge 70 of guide 22 to fully cooperate in consistently holding successive increments of the folded portion 32 of the fabric 28 snugly against the edge 70 of the guide 22 as they slide smoothly along the guide out of attachment 2 and into the sewing zone Z under full control. This controlled escort of the fabric 28 means that the distance d from seam path 51, that ultimately becomes the final uniform seam 51*a*, to the folded portion 32 of the fabric, will be maintained throughout tube sewing once it is set at a fixed value pursuant to the desired fabric tube diameter. In other words, this distance d will remain substantially constant as successive incremental portions of the fabric are fed to and engaged by the feed dog (not shown) along seam path or line 51 after passing through and out of attachment 2 under presser foot 4 and needle 68 operating in the presser foot opening 66 and regardless of any irregularities in the lapped edges 80 of the fabric.

Figure 5:
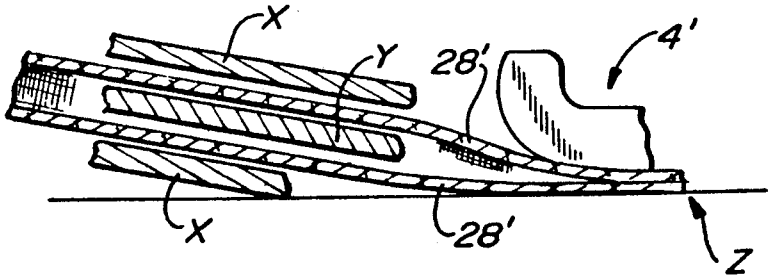
FIG. 5 is an enlarged and fragmentary elevational view with parts omitted when taken within the circumscribing circle 5 of FIG. 3 and illustrates in a manner similar to FIG. 1*a* passage of the successive portions of the fabric uniformly and evenly into the sewing zone.
Figure 7:
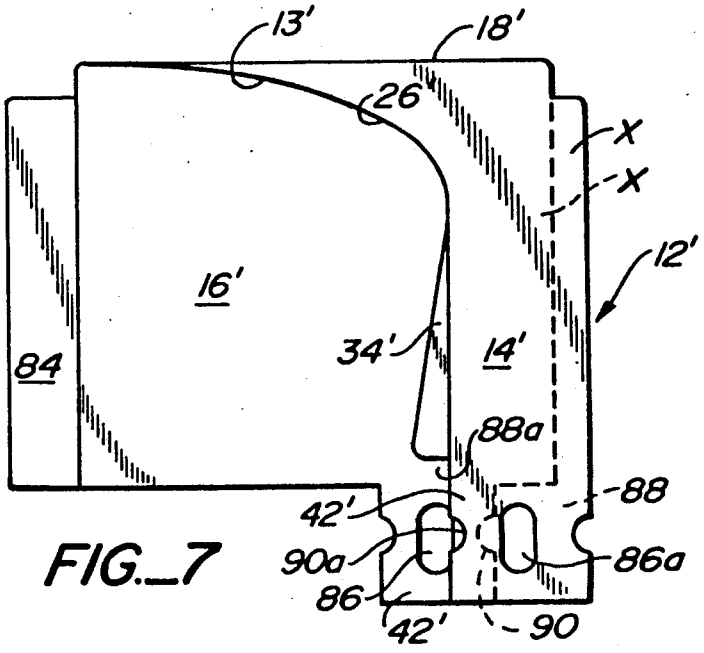
FIG. 7 is a top plan view of one form of an outer guide housing that can be used in conjunction with the guide of FIG. 6.
Figure 4:
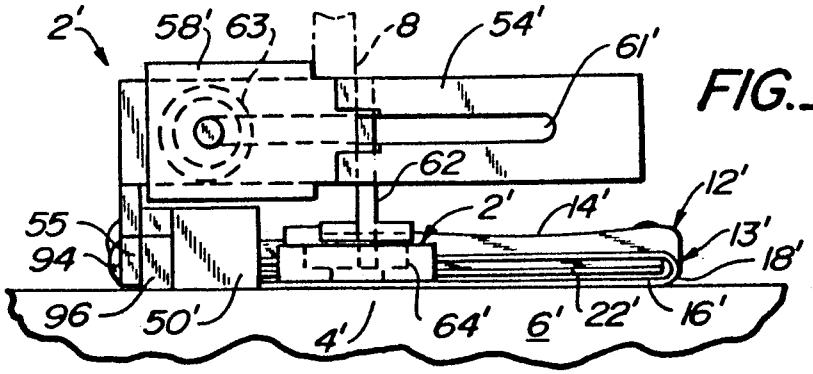
FIG. 4 is an end elevational view of the attachment of FIG. 3 when taken along the line 4—4 thereof.

A further advantageous feature of the sewing machine attachment 2 of the invention, and as particularly indicated in FIGS. 1*a* and 5, resides in the manner in which the trailing edges x and y of housing and guide extensions 42 and 44 respectively, i.e. those portions of members 12 and 22, which are located closely adjacent the sewing zone Z, slope or, are inclined downwardly. In the case of the attachment shown in FIG. 1, this is accomplished by bending down the trailing edge portions x and y from the normal plane of attachment 2 which is somewhat elevated by virtue of the two support legs 82 (only one of which is shown) for housing 12. In the attachment embodiment shown in FIGS. 2–7, which is to be described hereinafter, the main body portions of guide housing 12' and guide plate 22', are given a continuous gentle slope including the trailing edge portions x and y thereof by virtue of the downwardly bent frontal ramp 84 of this embodiment of the invention. This trailing edge arrangement for the guide housing and plate is additional insurance that the top and bottom layers of successive portions of the fabric strip 28 will be uniformly and evenly introduced into the sewing zone. Also, the consistency of cross-section in the finished tubular fabric is preserved by preventing the top and bottom fabric layers from pulling against each other due to the differential distance these layers must travel from the presser foot 4 to the sewing zone Z.

The embodiment of sewing machine attachment shown in FIGS. 2–7 will now be described. It is similar in most respects to that depicted in FIGS. 1 and 1*a*. It differs from the embodiment of FIGS. 1 and 1*a* primarily in the manner in which housing 12' and guide 22' are attached to the transition member 50', the previously described fashion in which the trailing portions x and y of housing 12' and guide 22' are sloped to meet bed plate 6 and the type of knurled shoulder screw 63 used to lock attachment 2 to the presser foot 4.

Accordingly, for ready reference purposes, the elements of FIGS. 2–7, that generally correspond to similar elements in FIGS. 1 and 1*a* have been identified and distinguished by prime reference numerals to the extent practical. Guide housing 12' can be formed from a bent piece of metal to include top and bottom leg extensions 42'. The leg extensions 42' of bottom leg 16' includes angular and arcuate cutaway segments 88 and 90 as well as an elongated perforation 86. Leg extension 42' of leg 14' is provided with similar cutaway segments 88*a* and 90*a* and a perforation 86*a*. Leg extension 44' of inner guide plate 22', which likewise can be formed from a piece of metal, contains circular perforations or openings 92. The purpose of the perforations and cutaway sections will now be discussed in connection with the attachment of housing 12' and guide 22' to the transition member 50' which can be made of any suitable plastic material. With guide 22' properly arranged and held within housing 12' so that edge 70' of guide 22' and web 18' of housing 12' will converge without contacting, as previously described, leg extensions 42' and 44' thereof are introduced into suitable injection molding equipment. While positioned in such equipment transition member 50' is shaped into the desired configuration in a fashion well known in the art. During the same molding operation plastic parts of transition member 50' will surround the housing 12' and guide 22' to become molded about housing 12' and guide 22' as well as being permanently embedded in the various perforations and cutaway sections of the same leg extensions in the manner shown in FIG. 2 thereby firmly anchoring the housing 12' and guide 22' to the transition member 50'.

A separately formed combination slide bar 54' and connector arm 55 may be affixed by rivets 94 or the like to the extension 96 of the molded transition member 50' for adjustably mounting the attachment of FIG. 2 to the presser foot 4 in a fashion similar to the embodiment of the invention of FIG. 1, i.e. crossways to the presser foot 4. As previously noted in connection with the attachment 2 of FIG. 1, the transition member 50', slide bar 54' and connector arm 55 of attachment 2' all can be injection molded or manufactured in any suitable manner well known to those skilled in the art.

Figure 8:
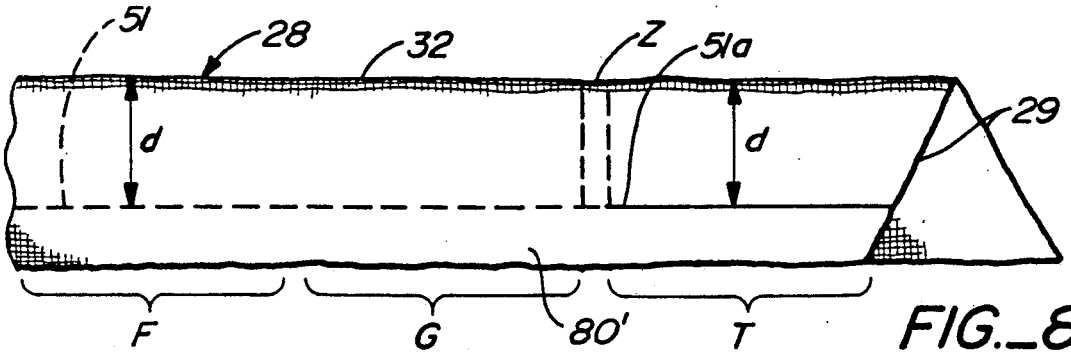
FIG. 8 is a diagrammatic illustration of the basic and successive steps involved in practicing the method of the instant invention.

From the above description it will now be evident, reference being made especially to FIG. 8 along with FIG. 1, that a simplified piece of equipment, as well as a simplified sewing method, has been developed for producing on a consistent basis uniformly sized fabric tubing in various sizes and from a wide assortment of differently cut fabric materials including loosely woven materials. The seamstress, tailor, upholsterer and homemaker, with one of the embodiments of the sewing machine attachment in place merely has to select and cut a given length of fabric 28 which can be cut on the bias. Next, an intermediate portion and preferably the middle portion of the fabric is folded along its length in a folding zone F and then progressively and incrementally fed with the two free marginal edges of the fabric registered and overlapped from the folding zone F into and through the housing 12 or 12' and into engagement with guide 22 or 22' in a guide zone G. The folded fabric is next directed from the guide zone G to a sewing zone Z where the fabric 28 is engaged by the usual feed dog and reciprocating needle. Once the fabric is engaged by the feed dog all the operator has to do is to continue to direct the folded edge 32 of the fabric to the guide 22 or 22' which has now taken over automatic control of the feeding of the fabric to the sewing needle while keeping the cut edges in registry. As the guide 22 or 22' engages the fabric it will maintain the preselected distance d between fabric fold 32 and fabric sewing path or line 51, that is linearly aligned with the sewing needle, at a fixed and constant value as the successive increments of the fabric are presented to the needle until the full length of fabric is seamed in a uniform and even manner. In other words, if the preselected distance d is set at 1" (2.54 cm), this same distance will prevail between the folded edge of the fabric and the finished seam 51*a* consistently for substantially the entire length of the finished tube T as shown in FIG. 8. Using the novel sewing machine attachment of the invention, the sewing machine operator no longer has to rely on frequently uneven lapped marginal edges of a fabric as an imperfect guide medium for seaming fabric tubing.

Advantageous embodiments of the invention have been shown and described, it will be obvious that various changes and modifications may be made thereto without departing from the spirit and scope thereof as defined in the appended claims.

What is claimed is:

1. A sewing machine attachment for use in sewing a fabric tube formed from folded and overlapped top and bottom fabric layers and provided with a desired consistently uniform diameter and a straight and even seam along substantially the tube's entire length, the attachment comprising:

(a) a guide housing provided with a fabric receiving linearly extending channel portion that includes a web, the channel portion having an entry and an exit end;

(b) a cooperating wrap-around guide wherein at least a portion is mounted within the channel portion of the housing; and (c) the wrap-around guide also having a linear edge portion for continuously engaging an inside of a folded edge of a length of fabric to be seam stitched into said tube, the linear edge portion extending from the entry end to the exit end of the guide housing channel portion in a gradually converging but noncontacting relationship with the web of the guide housing channel portion such that the folded edge of successive increments of the length of fabric will be continuously directed along and held snugly against the linear edge portion of the guide while at the same time a preselected distance between the folded edge of the fabric and a projected seam path, which path both parallels the fabric's folded edge and is linearly aligned with a sewing machine needle, and will be maintained at a constant preselected value relative to the folded edge as the successive increments of the fabric exit from the guide housing and are engaged by the sewing machine needle along the projected seam path.

2. The attachment of claim 1 including means for adjusting the attachment relative to the sewing needle in accordance with the desired uniform diameter of the fabric tube to be formed.

3. The attachment of claim 1 including a sewing machine presser foot and means for adjustably securing the housing and the guide to the presser foot.

4. The attachment of claim 1 wherein the fabric entry end of the housing and the guide are provided with cutaway portions to facilitate threading of the top and bottom layers of the folded length of fabric between the housing and the guide.

5. The attachment of claim 1 wherein the guide is provided with a forwardly projecting finger segment for initially engaging the fabric to be formed into the tube.

6. The attachment of claim 1 wherein the housing and the guide are provided with means at the trailing edge portions thereof for directing the folded layers of fabric evenly and uniformly towards the needle.

7. The attachment of claim 1 wherein the housing is provided with means for facilitating entry of the top layer of the fabric between the housing and the guide.

8. The attachment of claim 2 wherein the housing and the guide are provided with means at the trailing edge portions thereof for directing the folded layers of fabric evenly and uniformly towards the needle.

9. A method for forming a fabric tube of consistently uniform diameter and cross-sectional configuration along substantially the tubes entire length comprising the steps of:

(a) selecting and cutting a piece of fabric into a given length;

(b) progressively folding the cut length of fabric along an intermediate portion thereof to form a fold line in the fabric;

(c) next directing and guiding successive increments of the cut and folded fabric in a singular path towards a needle in a sewing zone, and while directing and guiding the successive increments of the cut and folded fabric toward the needle, maintaining, at a preselected fixed and constant value, a given distance between the fold line of the fabric and a projected seam line on the fabric that parallels the fold line and is located intermediate the fold line and the free-cut edges of the fabric while also being linearly aligned with the needle; and (d) continuing the directing and guiding until the length of fabric is completely formed into said tube.

10. The method of claim 9 including the step of initially cutting the fabric on the bias.

11. The method of claim 9 including the step of inverting the fabric tube upon being completely formed into said tube.

12. A sewing machine attachment for use in sewing a fabric tube formed from folded and overlapped top and bottom fabric layers and provided with a desired uniform diameter and cross-section and a straight an seven seam along substantially the tube's entire length comprising in combination with a presser foot:

(a) a guide housing provided with a fabric receiving linearly extending channel portion that includes a web, the channel portion having an entry end and an exit end;

(b) a cooperating wrap-around guide wherein at least a portion is mounted within the channel portion of the housing; and (c) the wrap-around guide also having a linear edge portion for continuously engaging an inside of a folded length of fabric to be stitch seamed into said tube, the linear edge portion extending from the entry end to the exit end of the housing channel portion in a gradually converging but noncontacting relationship with the web of the guide housing channel portion such that the folded edge of successive increments of the length of fabric will be directed along and held snugly against the linear edge portion of the guide while at the same time a preselected distance between the folded edge of the fabric and a projected sewing seam path, which path both parallels the fabric's folded edge and is linearly aligned with the sewing machine needle, and will be maintained at a constant preselected value relative to the folded edge as successive increments of fabric exit from the housing and are engaged by the needle along the projected seam path; and (d) means for adjustably securing the housing and the guide to and crossways of the presser foot.

13. The attachment as set forth in claim 12 wherein the adjustably securing means includes a transition member.

14. The attachment as set forth in claim 12 wherein the housing and the guide are provided with means at the trailing edge portions thereof for directing the folded layers of fabric evenly and uniformly towards the needle.

* * * * *